US007523514B2

(12) United States Patent
Salt et al.

(10) Patent No.: US 7,523,514 B2
(45) Date of Patent: Apr. 28, 2009

(54) ACCESSORY SUPPORT FOR A STRETCHER

(75) Inventors: Doug Salt, Delta (CA); Dennis John Schweers, Burnaby (CA); Arthur Francis Cogswell, Vancouver (CA)

(73) Assignee: Children's & Women's Health Centre of British Columbia Branch, Vancouver, British Columbia (CA)

( * ) Notice: Subject to any disclaimer, the term of this patent is extended or adjusted under 35 U.S.C. 154(b) by 0 days.

(21) Appl. No.: 12/107,730

(22) Filed: Apr. 22, 2008

(65) Prior Publication Data

US 2008/0301874 A1 Dec. 11, 2008

Related U.S. Application Data

(62) Division of application No. 11/186,082, filed on Jul. 20, 2005, now Pat. No. 7,376,992.

(51) Int. Cl.
*A61G 1/00* (2006.01)
*A61G 1/04* (2006.01)

(52) U.S. Cl. ..... 5/503.1; 5/658; 5/626; 128/845

(58) Field of Classification Search ..... 5/503.1, 5/658, 626, 425, 625, 628, 600, 611; 128/845; 248/49, 51, 68.1
See application file for complete search history.

(56) References Cited

U.S. PATENT DOCUMENTS 2,564,333 A 8/1951 Kelly
4,060,079 A 11/1977 Reinhold, Jr.
4,224,936 A 9/1980 Cox
4,557,453 A 12/1985 McCloskey
4,584,989 A 4/1986 Stith
4,747,172 A 5/1988 Hohol et al.
4,768,241 A 9/1988 Beney
4,783,109 A 11/1988 Bucalo
4,957,121 A 9/1990 Icenogle et al.
5,152,486 A 10/1992 Kabanek et al.
5,362,021 A 11/1994 Phillips
5,535,964 A 7/1996 Ahlsten
5,749,374 A 5/1998 Schneider, Sr.
5,802,636 A 9/1998 Corbin et al.
5,836,026 A 11/1998 Reed
5,845,351 A 12/1998 Berta et al.
6,195,821 B1 3/2001 Hall et al.
6,375,133 B1 4/2002 Morrow
6,446,285 B1 9/2002 Chinn
6,493,890 B2 12/2002 Smeed
7,083,150 B2 8/2006 Newkirk et al.

OTHER PUBLICATIONS

Interview Summary from U.S. Appl. No. 11/186,082, filed Jul. 20, 2005, submitted Dec. 28, 2007 (and resubmitted via EFS on Jan. 30, 2008), 1 page.

*Primary Examiner*—Alexander Grosz
(74) *Attorney, Agent, or Firm*—Klarquist Sparkman, LLP

(57) ABSTRACT

An accessory support system adapted for use with a stretcher with a mattress, the mattress being supported by a frame. A segment of an elongated rail member is spaced apart from the mattress a sufficient distance to enable an accessory support mounted on the segment to be moved free from interference from the mattress. A cable support is aligned with the segment adapted to support a portion of cabling of an accessory mounted on the support, the cable support capable of receiving and retaining cabling from the accessory irrespective of the position of the accessory support on the segment.

14 Claims, 7 Drawing Sheets

ACCESSORY SUPPORT FOR A STRETCHER

CROSS REFERENCE TO RELATED APPLICATIONS

This application is a divisional application of Ser. Mo. 11/186,082, filed Jul. 20, 2005 now U.S. Pat. No. 7,376,992. This application is incorporated herein in its entirety.

BACKGROUND OF THE INVENTION

This invention relates generally to a support system for mounting accessories to a stretcher and more specifically to a support system which permits unencumbered movement of the accessory along the side of the stretcher and controlled storage of cabling associated with the accessory irrespective of the position of the accessory along the side of the stretcher.

SUMMARY OF THE INVENTION

Stretchers are commonly used in the medical field by medical professionals to transport patients from one location to another. Patients being transported on stretchers can often suffer from various serious illnesses or injuries. Often those illnesses or injuries require attention at hospital facilities a considerable distance from the location of the patient. This can occur where the accident site is a remote distance from the hospital or where critically ill patients must be transferred from one hospital or care facility to another in order to obtain the necessary treatment. Due to the critical nature of those injuries or illnesses transportation of the patient to the hospital facility must be undertaken as quickly as possible. Delay can often lead to death or serious complications for the patent. As a consequence, patients and their supporting stretchers are often transported from the patient's location to a remote hospital facility by means of an aircraft, such as an airplane or a helicopter.

Primarily due to the increased complexity of medical equipment and medical procedures required for the in-transit support and care of patients numerous complex equipment (accessories) must travel with the patient and, preferably, be affixed to the stretcher. At the same time, aircraft have restrictive door height and width parameters which must be adhered to in establishing the maximum dimensions of the stretcher loaded with the patient and equipment. Otherwise the stretcher, loaded with the patient and equipment, will not pass through the aircraft door openings to gain entry into and to exit from the aircraft. If the loaded stretcher were to exceed the aircraft door dimensions equipment would have to be removed from the stretcher thereby causing a significant delay in entering and exiting the aircraft and requiring the attendants to concern themselves with separately transferring the removed equipment to be re-installed after entering or exiting the aircraft. Removal of the equipment can also result in risk to the patient in the event that the cabling for that equipment is separated, either deliberately to reduce the dimensions of the stretcher or accidentally when the equipment is removed from the stretcher causing cabling to be separated from the patient, or from the power source or from associated equipment such as monitoring equipment.

For example, a patient with a serious heart condition who requires transportation to a remote facility to obtain necessary heart surgery will require the following medical devices to accompany that patient during transportation:

- Transport ventilator
- Patient monitor ($SaO_2$ sensor, ECG, invasive BP, invasive CVP, temperature)

- Multiple intravenous pumps
- Extra corporeal life support ("ECLS") equipment (VA-ECMO, VV-ECMO, LVAD, RVAD, BiVAD, IABP, TAH, etc.)

This medical equipment is large and includes various cabling requirements for each of the above equipment, as follows:

- Transport ventilator:
  - Electrical supply, oxygen/air supply lines, gas blender attachment lines, airway circuit
- Patient monitor:
  - Pulse oximetry cable, electrical supply, ECG cable, arterial transducer cable and fluid tubing, CVP transducer cable and fluid tubing, temperature probe cable
- Multiple intravenous pumps:
  - Intravenous fluid tubing (usually more than 5)
- ECLS equipment:
  - Examples of ECLS equipment cabling: electrical supply, drive line, device monitoring line, flow probe cable, circuit tubing, pressure monitoring transducer lines, fluid administration tubing, blood sampling manifold, temperature control water lines, temperature probe cable, gas supply lines, etc.

In order to ensure that the patient and stretcher are of a suitable dimension to permit entry and exit from an aircraft, the stretcher must be configured in such a manner such that the combination of the stretcher, the attached equipment and the patient do not exceed those dimensions. This usually requires that the medical equipment be attached to the stretcher in a manner which extends that equipment in a cantilevered fashion over the patient, or alternatively, under the stretcher. This maintains the outer dimensions of the stretcher, equipment and patient within, or slightly exceeding, the outer limits of the stretcher frame itself, which is usually narrow enough to fit within the width of a typical aircraft door. As an aircraft door is generally much higher than it is wide, there is usually some room for medical equipment to be attached above the stretcher and patient and still fit well within the vertical height dimensions of a typical aircraft door.

With the number and complexity of equipment required for transportation of an injured or ill patient, comes the associated number and complexity of various cabling associated with each piece of equipment. This can include power cables, monitoring cables and various cables attached to the patient at one end and equipment at the other. If not properly organised and affixed to the stretcher, that loose cabling can become entangled with the patient, with components of the stretcher, with other cables and/or with adjacent areas of the aircraft as the patient is moved into and within the close confines of the interior of the aircraft.

Moreover, it is often necessary to attach or remove various pieces of equipment, or adjust the position of various equipment along the sides of a stretcher, in order to ensure proper operation. For example, cabling can be of a certain length requiring equipment to be located close to the appropriate region of the patient to which associated cabling must extend. In addition, in order to facilitate placing the patient on the stretcher, or removing the patient from the stretcher, equipment affixed to the side of the stretcher may have to be removed or repositioned at one or the other ends of the stretcher. Often removal or repositioning of equipment must be undertaken without unduly disturbing or moving the cabling associated with that equipment or cabling associated with other equipment attached to the stretcher and used in monitoring or otherwise caring for the patient.

There is consequently a need for a stretcher system which includes an accessory support for supporting an accessory for use with a patient resting on the stretcher which is movable longitudinally along the side of the stretcher and which may be affixed at any number of positions along that side.

There is a further need for a stretcher system which includes a cable support associated with the stretcher and the accessory support which can support a portion of cabling of the accessory and other accessories associated with the stretcher when attached to the support and which is capable of receiving and retaining a portion of the cabling, irrespective of the position of the accessory support along the side of the stretcher.

There is also a need for a combination rail segment that permits movement of an accessory support along the rail adjacent the stretcher with a cabling support in spaced alignment with the rail to facilitate attachment of cabling to the cable support irrespective of the position of the accessory on the accessory support adjacent the stretcher.

In accordance with an embodiment of the invention a stretcher includes a frame, a mattress supported by the frame, an elongated rail member attached to the frame with the rail member having a segment spaced apart from the mattress and the frame, and an accessory support attached to the segment for supporting an accessory for use with the stretcher. The segment is spaced apart from the mattress sufficiently so that the accessory support is free from interference from the mattress and the frame when the accessory support is attached at any point along the segment. A cable support communicates with the segment and extends at least the length of the segment, the cable support adapted to support a portion of cabling of the accessory when the accessory is attached to the support, the cable support being capable of receiving and retaining a portion of the cabling irrespective of the position of the accessory support on the segment.

The stretcher may include a cable support having a first trough with the portion of the cabling retained within the first trough. The first trough may comprise an opening facing the segment. Alternatively, the first trough may be located along the longitudinal side of the frame. As a further alternative, the first trough may be of a U-shaped cross-section with the opening facing the segment. Alternately, the stretcher may include a mount for connecting an accessory to the support. As a further alternative, the accessory support may be movable longitudinally along the segment.

The stretcher may further include a pair of attachment members connecting the rail member to the frame longitudinally spaced from one another along the rail with the segment of the rail member located between the attachment members.

In a further alternative, the accessory support may be securable as desired in a selected one of a plurality of predetermined positions along the segment of the rail member. In another alternative, the accessory support may be securable as desired in any position along the segment of the rail member.

In another alternative, the attachment members may be sufficiently long to space the rail above the frame a distance sufficiently greater than the thickness of the mattress, to enable the rail to impede a patient resting on the mattress from falling from the stretcher. In another embodiment, the attachment members comprises a plurality of attachment members extending vertically above the frame and positioned along the rail to impede a patient resting on the mattress from falling from the stretcher. Alternatively, the accessory support may comprise a plurality of accessory supports spaced longitudinally on the rail and extending vertically above the rail to impede a patient resting on the mattress from failing from the stretcher.

The stretcher may further include a second trough located along the opposite side of frame from the first trough.

As a further alternative, the segment may be spaced apart from the mattress the minimum distance necessary to enable the accessory support, when mounted on the segment, to be free from the said interference.

The cabling may alternatively be retained in the first trough by friction fit with the first trough.

In an alternate embodiment the cable support may be rigidly connected to the frame and comprise a gripping region which may be grasped to support the stretcher. Alternatively, the gripping region may extend longitudinally beyond the frame. In a further alternative, the cable support may be aligned with the segment. As a further alternative, the cable support may be positioned in spaced parallel alignment with the segment. In yet a further alternative, the cable support may be positioned below the segment.

In another embodiment of the invention an accessory supporting system for a stretcher having a mattress is provided which includes an elongated rail member, first and second attachment members configured to attach the system to the stretcher, the first and second attachment members defining a segment of the rail member between the attachment members, and an accessory support attached to the segment for supporting an accessory for use with the stretcher. The first and second attachment members are dimensioned sufficiently to space the segment away from the stretcher and the mattress when the system is attached to the stretcher so that the accessory support is free from interference from the mattress when the accessory support is attached to any part of the segment A trough is connected to the rail in spaced alignment with the segment and extends at least the length of the segment, the trough adapted to receive a portion of cabling of an accessory when mounted on the accessory support irrespective of the position of the accessory support on the segment.

DETAILED DESCRIPTION OF PREFERRED EMBODIMENT(S)

Figure 1:
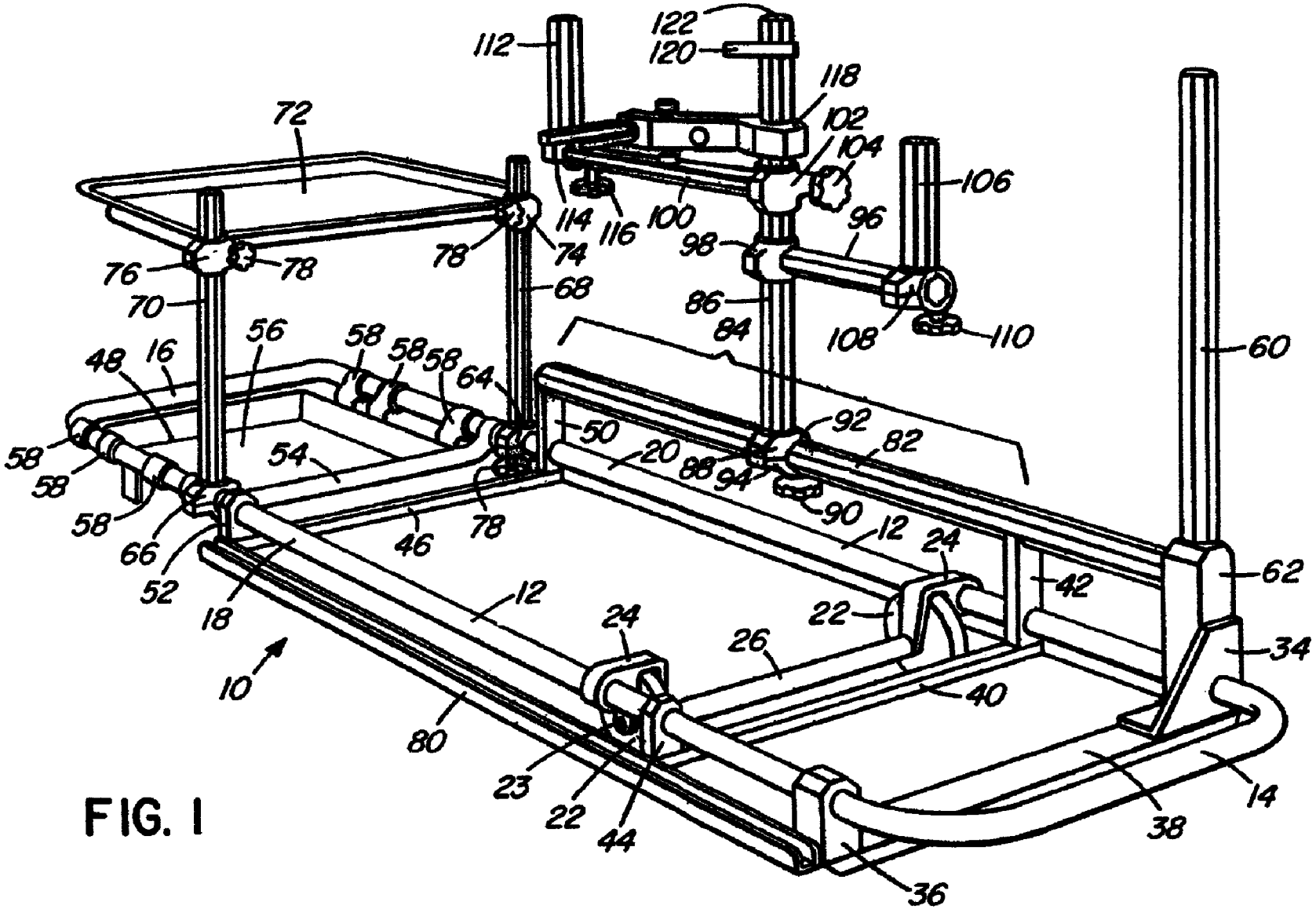
FIG. 1 is a perspective view of an upper portion of a stretcher, with the mattress removed, for carrying an ill or injured patient, according to a first embodiment of the invention.

FIG. 1 depicts a stretcher, with the mattress and undercarriage support structure omitted. Note that in describing components using the terms "left" and "right", those terms will be based on the left and right sides of a patient resting on the stretcher with his or her head at the head end of the stretcher and with the patient facing up. Stretcher 10 includes tubular frame 12 which generally encircles the outer periphery of stretcher 10. Frame 12 includes head end 14, foot end 16, left side 18 and right side 20. A pair of wheels 22 are connected to frame 12 by means of wheel mounts 24 in a typical fashion common with various stretcher systems. An intermediate tubular spacer 26 extends between wheels 22. Spacer 26 is connected to wheel mounts 24 at each end of spacer 26. Wheel mounts connect wheels 22 to frame 12 in a manner which permits rotation of wheels 22 about wheel axis 23.

A removable nylon sling (not shown in FIG. 1) may be attached to frame 12 at left side 18, right side 20, head end 14 and foot end 54. Right mounting rail brace 34 and left head end mount 36 connect to frame 12. Head end cross brace 38 provides structural rigidity to frame 12 at head end 14 and is positioned adjacent head end 14 between mounts 34 and 36.

Mid rail cross brace 40 is positioned adjacent wheels 22 on the side of wheels 22 toward head end 14 of frame 12. Right mount 42 and left mount 44 secure cross brace 40 to frame 12, with right mount 42 attached to right side 20 and left mount 44 attached to left side 18.

Similarly, foot end cross brace 46 provides structural support to foot end 48. Cross braces 40 and 46 also function to distribute weight from side 20 to side 18. Right mount 50 attaches cross brace 46 to right side 20 and left mount 52 attaches cross brace 46 to left side 18 of frame 12.

Figure 2:
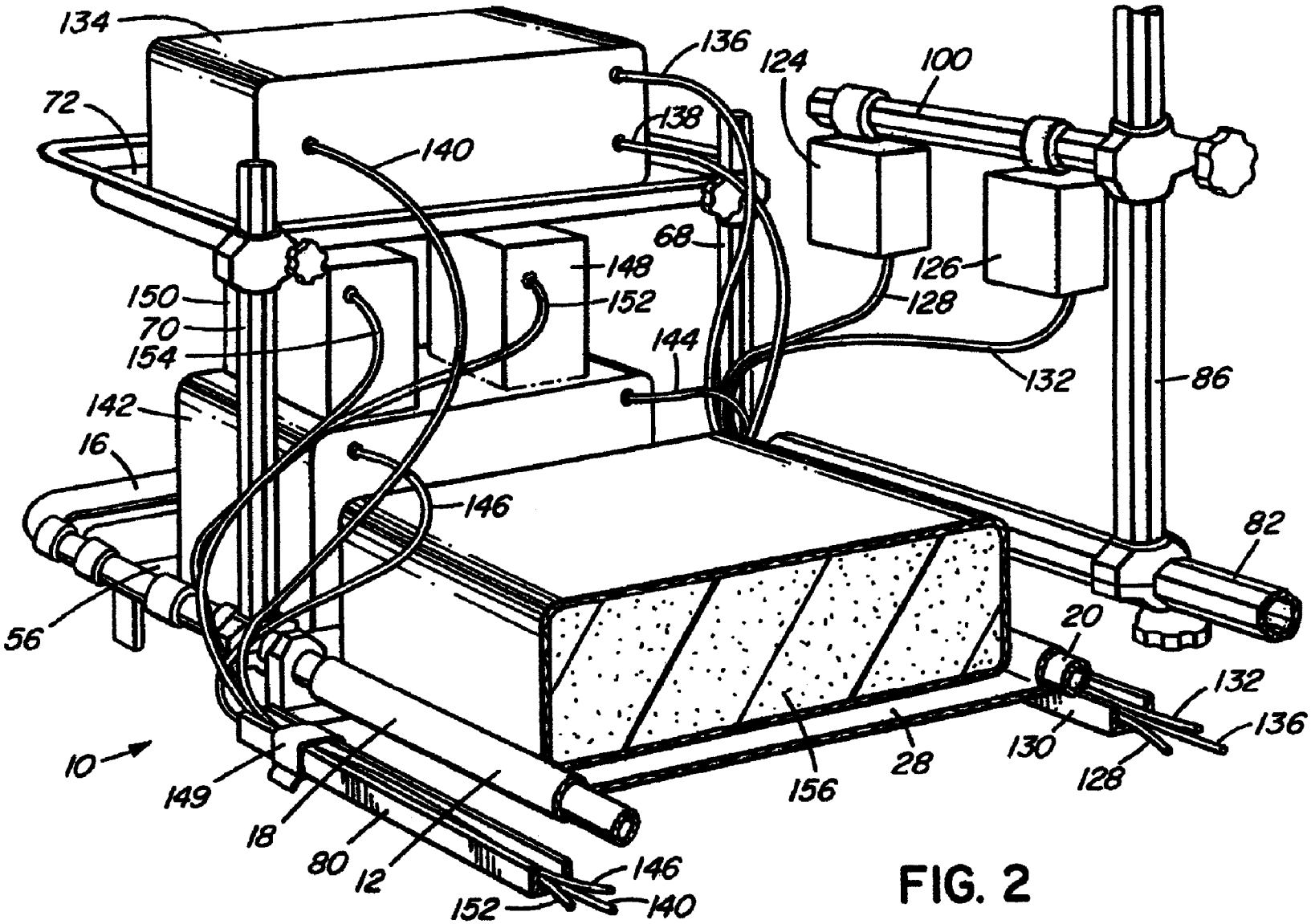
FIG. 2 is a perspective view of a portion of the stretcher of FIG. 1, with a portion of the mattress, as well as various medical equipment shown.

Frame 12 further includes frame cross brace 54 attached to left side 18 and right side 20 of frame 12 toward foot end 16 of frame 12. Equipment mounting platform 56 is attached to frame 12 adjacent foot end 16 by means of attachment members 58. Equipment mounting platform 56 supports the mattress which in turn, supports the lower legs and feet of the patient when resting on stretcher 10. As well, platform 56 can support medical equipment placed on the mattress between the patient's legs. As well for an infant or child whose legs do not reach past foot end frame cross brace 54, medical equipment can be placed on platform 56 without the need to ensure space to accommodate the legs of the patient. This is best seen in FIG. 2.

Ventilator mounting mast 60 extends vertically above frame 12 and is mounted to frame 12 by means of mount 62 attached adjacent head end 14 to right side 20 of frame 12. A pair of foot end clamps, that is, right clamp 64 and left clamp 66 connect respective right rear mast 68 and left rear mast 70 to frame 12 between frame cross brace 54 and mounts 50 and 52. Upper equipment platform 72 is attached to masts 68 and 70 by means of right platform clamp 74 and left platform clamp 76.

It should be noted that clamps 64, 66, 74 and 76 include clamping means which may be tightened or loosened using clamp knob 78 to permit removal of masts 68 and 70 from frame 12 and removal or upward and downward movement of platform 72 with respect to masts 68 and 70, as desired at the option of medical personnel. For example, removal of mast 70 and platform 72 can facilitate the placement or removal of the patient from stretcher 10.

Left trough 80, which acts as a cable support, is positioned along a longitudinal side of stretcher 10 between left mount 52 and left mount 36. Left trough 80 is attached to left head end mount 36, left intermediate mount 44 and left foot end mount 52. Right trough 130 (shown in FIGS. 2 and 3) extends along the opposite side of frame 12 adjacent a portion of right side 20 of frame 12. Right trough 130 is attached to ventilator head and rail mount 62, right intermediate mount 42 and right foot end mount 50.

Horizontal elongated rail member 82 is connected to mount 62 adjacent head end 14 of frame 12 at one end and is connected to mount 50 at its opposite end. Rail member 82 is further connected to right side 20 of frame 12 at an intermediate position by means of mount 42. Mounts 42 and 50 act as attachment members attaching rail member 82 to frame 12 and defining segment 84 of rail member 82. Vertical mast 86, acting as an accessory support, is connected to rail member 82 and segment 84 by means of clamp 88 releasably attached to rail member 82 by means of knob 90. Knob 90 is used to tighten or loosen clamp 88 permitting clamp 88 and mast 86 to be moved along rail member 82 between mounts 42 and 50 along segment 84 when clamp 88 is loosened. Rotation of knob 90 to separate clamp 88 into upper component 92 and lower component 94 permits removal of mast 86 from rail member 82.

Lower horizontal arm 96 is connected to mast 86 by means of clamp 98 and upper horizontal arm 100 is connected to mast 86 by means of clamp 102. Clamps 108 and 102 can be loosened by means of a knob (knob 104 being shown with respect to clamp 102) to permit movement of arms 96 and 100 vertically along mast 86.

Vertical extension 106 is connected to lower horizontal arm 96 by means of clamp 108 which can be tightened or loosened by rotating knob 110 to permit horizontal movement of extension 106 along arm 96, or removal of extension 106 from arm 96. Similarly, vertical extension 112 is attached to upper horizontal arm 100 by means of clamp 114 which can be tightened or loosened by means of knob 116 to permit removal or movement of extension 112 with respect to arm 100.

Support member clamp 118 extends horizontally from mast 86 and is releasably attachable to mast 86. Support member clamp 118 is a universal-type equipment support to which various types of medical equipment may be fastened and supported.

Upper retaining bar 120 is releasably attachable to a region adjacent the upper end 122 of mast 86, although it could also be attached to any one of extensions 106 or 112, or masts 60, 68, 70 or 122. Upper retaining bar 120 is another equipment support to which various types of medical equipment may be fastened and supported.

FIG. 2 depicts the foot segment of stretcher 10. Various types of medical equipment are positioned for use with stretcher 10. It should be understood that various medical equipment are shown schematically. Specific types of medical equipment suitable for use with a patient having a particular illness or suffering a certain type of injury will require appropriate medical equipment suitable for that patient, as will be apparent to one skilled in the art.

Medical equipment 124 and 126 are suspended from upper horizontal arm 100. Cable 128 extends from a lower portion of medical equipment 124 to extend within a section of right trough 130. Cable 132 extends from medical equipment 126 into right trough 130.

Medical equipment 134 rests on upper equipment platform 72. Cables 136 and 138 extend from equipment 134 into trough 130. Cable 140 extends from medical equipment 134 into left trough 80

Medical equipment 142 rests on foot rest platform 56. Cable 144 extends from equipment 142 into right trough 130. Cable 146 extends from equipment 142 into left trough 80.

Medical equipment 148 and 150 are positioned to rest on medical equipment 142. Cable 152 extends from medical equipment 148 into trough 80. Similarly, cable 154 extends from equipment 150 into trough 80.

As seen with reference to trough 80, Velcro tape clamp 149 may be fastened about trough 80 in order to retain cables 140, 146, 152 and 154 within trough 80.

FIG. 2 also depicts a foot portion of mattress 156 resting on nylon sling 28. Sling 28 is supported by frame 12 including left side 18 and right side 20.

Figure 3:
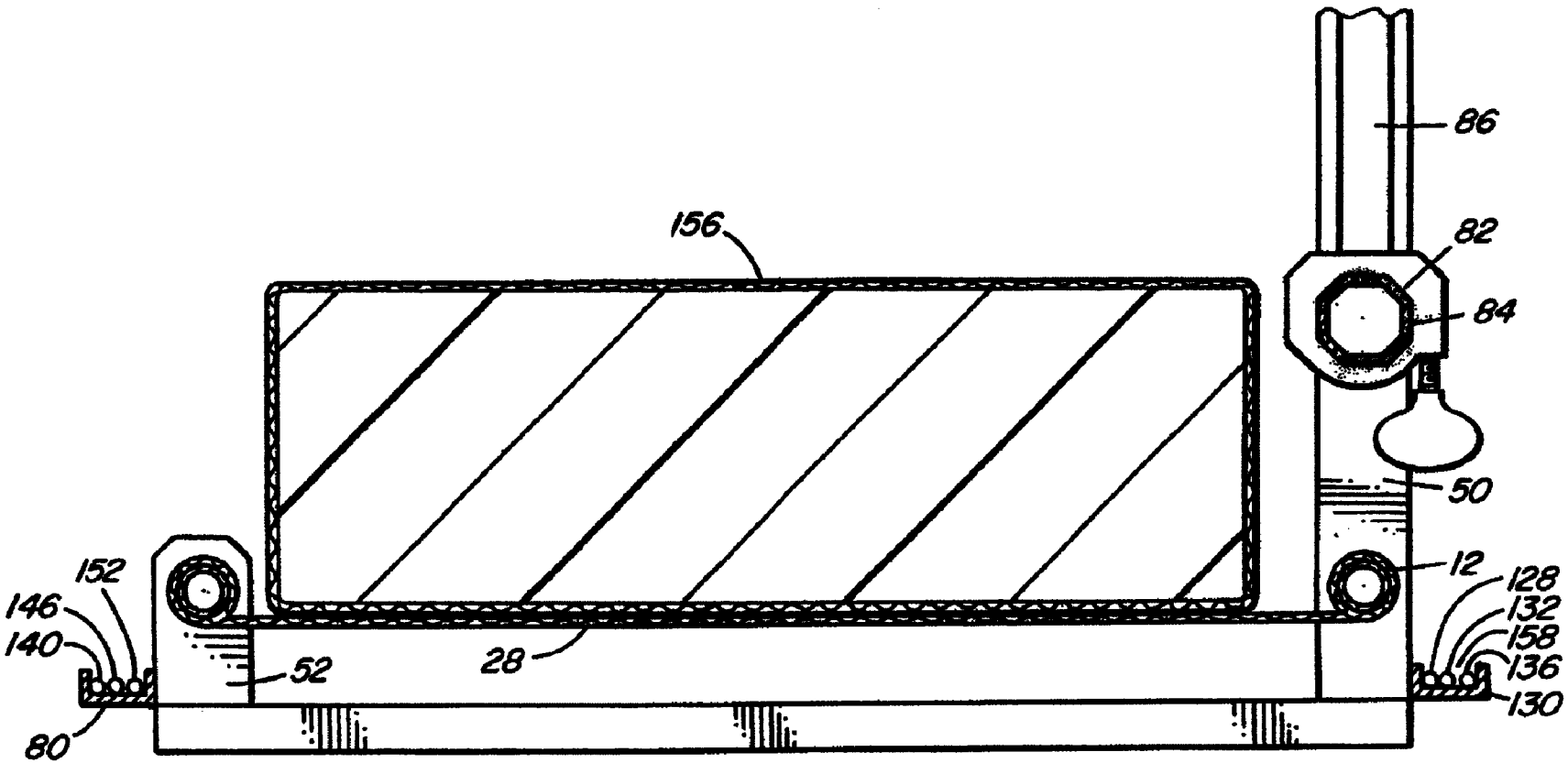
FIG. 3 is a cross-sectional view of the stretcher of FIG. 1.

FIG. 3 depicts stretcher 10 in cross section with mattress 156 resting on sling 28. Left trough 80 is depicted with cabling 140, 146 and 152 positioned within trough 80. Similarly, right trough 130 is shown containing cables 128, 132 and 136. Trough 130 is positioned below rail member 82 with opening 158 of trough 130 facing in an upward direction toward rail member 82. Troughs 80 and 130 are generally of U-shaped cross-section with an open upper portion.

Figure 4:
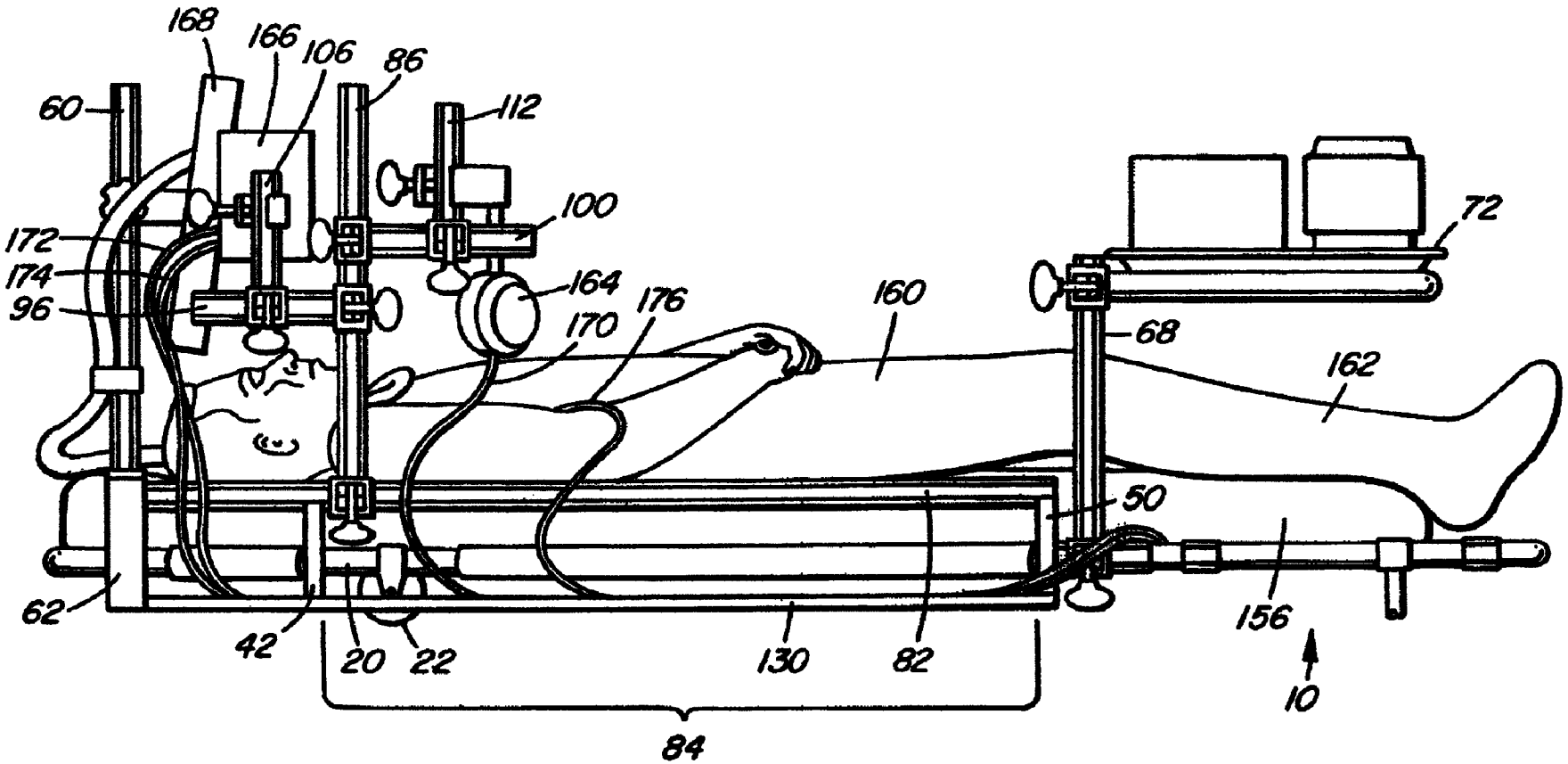
FIG. 4 is a side view of the stretcher of FIG. 1 with a patient resting on the mattress and showing various medical equipment in a first position.

As seen in FIGS. 3 and 4, rail member 82 is spaced from mattress 156 sufficiently so that accessory support 86 is free from interference from the mattress 156 and the frame 12 when accessory support 86 is attached at any position along segment 84.

FIG. 4 depicts stretcher 10 with patient 160 resting on mattress 156. The patient's legs 162 are positioned inside of right rear mast 68 between right rear mast 68 and left rear mast 70 (shown in FIG. 2). In FIG. 4 various types of medical equipment are shown for use with patient 160. Medical equipment 164 is suspended from vertical extension 112 which, in turn, is attached to upper horizontal arm 100. Medical equipment 166 is attached to vertical extension 106 which, in turn, is attached to lower horizontal arm 96. Arms 96 and 100 are attached to mast 86. Mast 86 supports medical equipment 164 and 166 and is attached to rail member 82. Rail member 82 includes segment 84 located between mounts 42 and 50. Medical equipment 168 is connected to mast 60.

Cable 170 extends from equipment 164 into trough 130 at a position near right mount 42. Cables 172 and 174 extend from equipment 166 into trough 130 at a point generally between mounts 42 and 62. Cable 176 extends from the patient and enters trough 130 generally near the midpoint between mounts 42 and 50. Cables 170, 172, 174 and 176 all are contained within trough 130 until those cables exit trough 130 adjacent mount 50, whereupon those cables are directed to associated equipment (not shown).

It should be noted that FIG. 4 depicts the accessory support, with the medical equipment 166 and 168 in a position generally adjacent mount 42 at the patient head end of segment 84.

Figure 5:
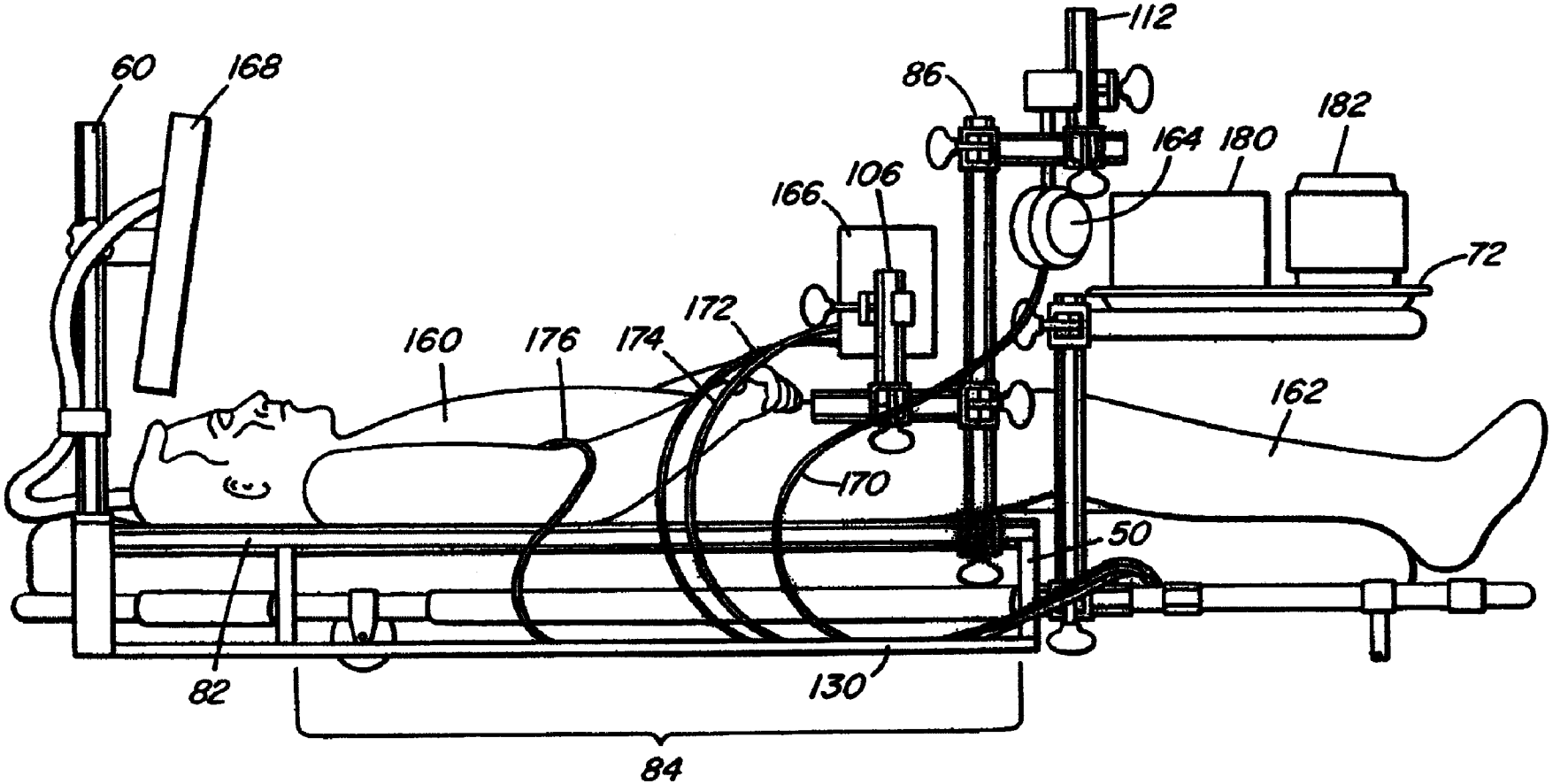
FIG. 5 is a side view of the stretcher of FIG. 1 with a patient resting on the mattress showing various medical equipment in a second position.

Referring to FIG. 5, mast 86 is depicted generally adjacent mount 50, at the foot end of segment 84. Cables 170, 172 and 174 remain partially retained within trough 130 when mast 86 is in a position adjacent mount 50. This ensures that cables 170, 172 and 174 are retained adjacent rail 12 to maintain cables 170, 172 and 174 in a controlled manner and to reduce the risk of one or more of cables 170, 172 and 174 extending beyond frame 12 to engage with objects adjacent stretcher 10. A portion of those cables 170, 172 and 174 are retained within trough 130, irrespective of the position of mast 86 on segment 84 of rail member 82.

Figure 6:
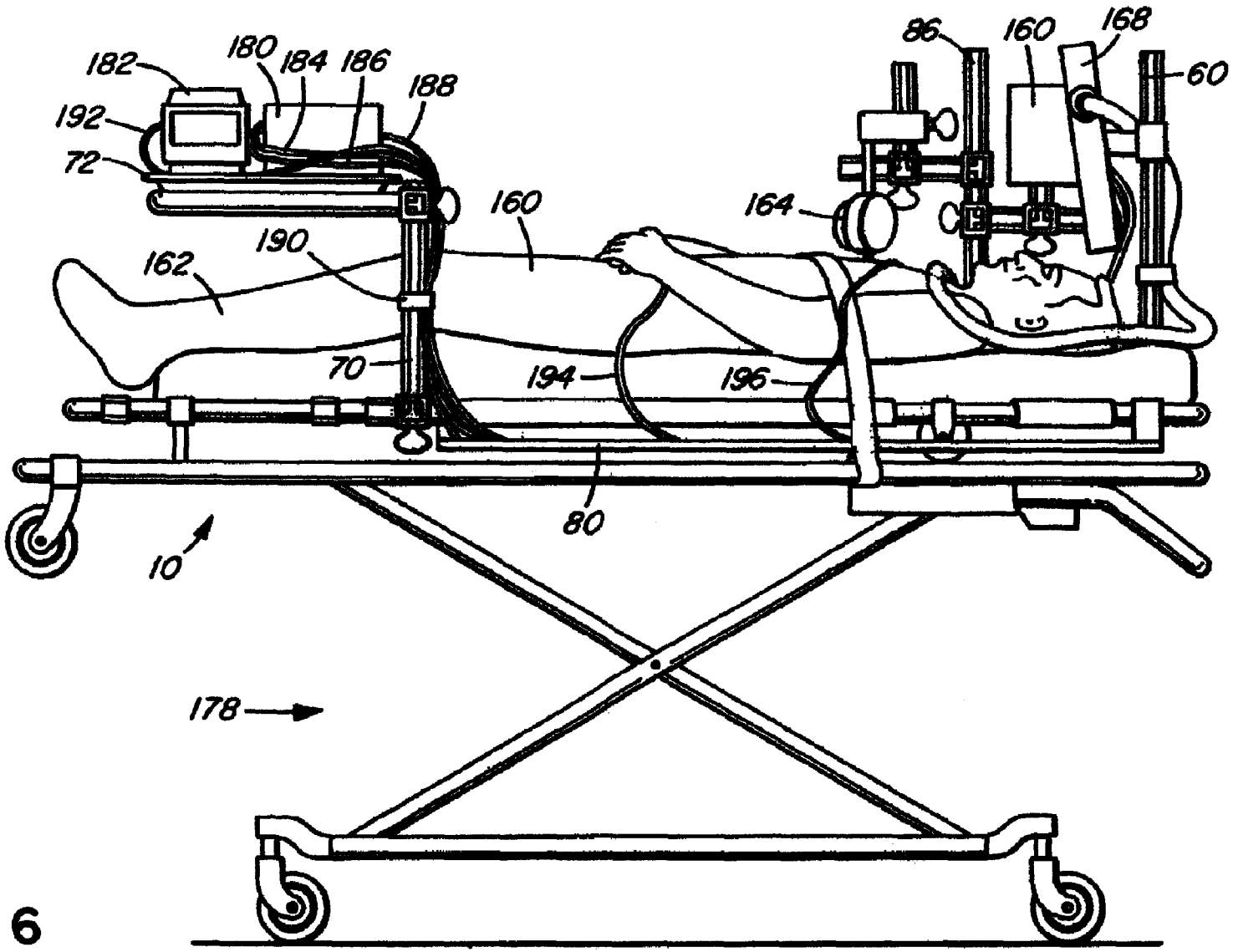
FIG. 6 is a side view of the stretcher of FIG. 1, resting on a stretcher support and mobility system showing various medical equipment in the first position, shown from a side opposite to that of FIG. 4.

Referring to FIG. 6, stretcher portion 10 is shown supported by wheeled stretcher undercarriage 178. Medical equipment 180 and 182 rest on upper equipment platform 72. Cables 184, 186 and 188 extend from equipment 180 along rear mast 70 into trough 80. Cable 192 extends from equipment 182 along mast 70 into trough 80 as well. Velcro tape clamp 190 retains cables 184, 186, 188 and 192 against mast 70 between platform 72 and trough 80. Cables 194 and 196 extend from patient 160 into trough 80. By directing cables 184, 186, 188 and 192 to trough 80, those cables are maintained in a controlled manner along frame 12, thereby preventing cables 184, 186, 188 and 192 from engaging with objects adjacent stretcher 10. Directing cables 184, 186, 188 and 192 to trough 80 will prevent those cables from becoming entangled with, or impeding the movement of, mast 86 as it is affixed at any position along segment 84.

Figure 7:
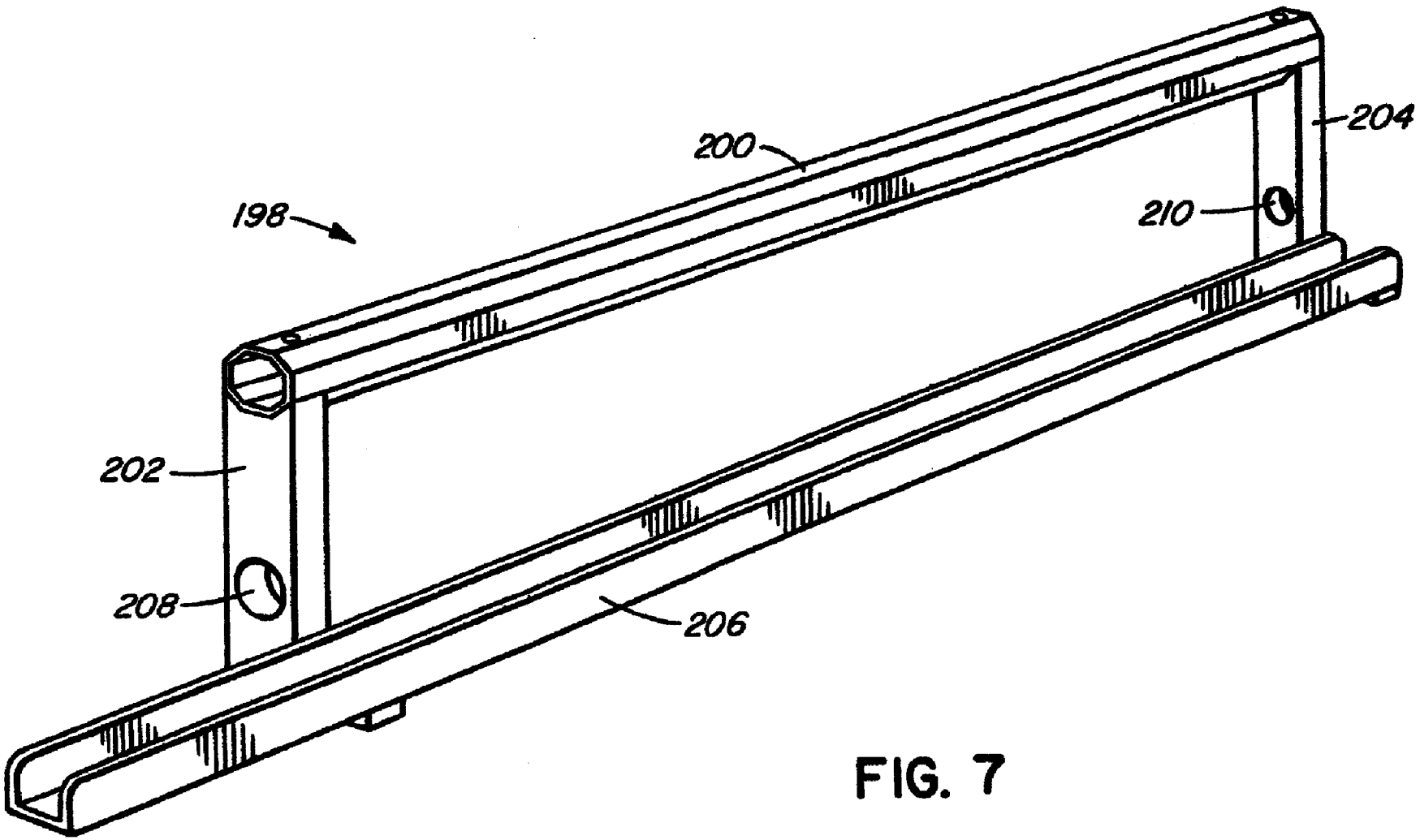
FIG. 7 is a perspective view of an accessory supporting system for a stretcher having a mattress of an alternate embodiment of the invention.

Referring to FIG. 7, accessory support system 198 is shown. Support system 198 consists of rail member 200, similar to rail member 82 discussed above with respect to the first embodiment. The first and second mounts 202 and 204 (similar to mounts 42 and 50) connect rail 200 to trough 206. Openings 208 and 210 extend through mounts 202 and 204 respectively. Openings 208 and 210 are in co-axial alignment and are dimensioned to permit system 198 to be attached to a typical stretcher, similar to that shown in FIG. 1, in order to retrofit a stretcher with accessory support system 198. A portion of the frame of the stretcher extends through openings 208 and 210 in order to connect system 198 to a stretcher. A mast acting as an accessory support, similar to mast 86, may be attached to rail 200 for movement from one end of rail 200 adjacent mount 202 to the other end of rail 200 adjacent mount 204, defining a segment similar to segment 84 of the first embodiment. In this manner, cabling from medical accessories, or medical equipment supported by a mast on the segment, can be placed within trough 206, irrespective of the position of the mast along rail 200 when support system 198 is retrofitted to an existing stretcher.

As will be apparent to those skilled in the art to which the invention is addressed, the present invention may be embodied in forms other than those specifically disclosed above, without departing from the spirit or essential characteristics of the invention. The particular embodiments of the invention described above are therefore to be considered in all respects as illustrative and not restrictive. The scope of the present invention is as set forth in the appended claims rather than being limited to the examples set forth in the foregoing description. Any and all equivalents are intended to be embraced by the claims.

The invention claimed is:

1. An accessory supporting system for a stretcher having a mattress, comprising:

(a) an elongated rail member;

(b) first and second attachment members configured to attach the system to the stretcher, the first and second attachment members defining a segment of the rail member between the attachment members;

(c) an accessory support attached to the segment for supporting an accessory for use with the stretcher;

(d) the first and second attachment members being dimensioned to space the segment away from the stretcher and the mattress when the system is attached to the stretcher so that the accessory support is free from interference from the mattress when the accessory support is attached to any part of the segment; and (e) a cable support connected to the rail member in spaced alignment with the segment and extending at least the length of the segment, the cable support adapted to receive and retain a portion of cabling of an accessory when mounted on the accessory support irrespective of the position of the accessory support on the segment.

2. The system as described in claim 1 wherein the cable support comprises a trough.

3. The system as described in claim 2 wherein the trough comprises an opening facing the segment.

4. The system as described in claim 2 wherein the trough is of a U-shaped cross-section with the opening facing the segment.

5. The system as described in claim 2 wherein the segment is spaced apart from the mattress the minimum distance necessary to enable the accessory support, when mounted on the segment, to be free from the said interference.

6. The system as described in claim 2 wherein the cabling is retained in the trough by friction fit with the trough.

7. The system as described in claim 1 further comprising a mount for connecting an accessory to the accessory support.

8. The system as described in claim 1 wherein the accessory support is movable longitudinally along the segment.

9. The system as described in claim 8 wherein the accessory support is securable as desired in a selected one of a plurality of predetermined positions along the segment of the rail member.

10. The system as described in claim 8 wherein the accessory support is securable as desired in any position along the segment of the rail member.

11. The system as described in claim 1 wherein the cabling is one or more power cables, signal cables and/or IV cables.

12. The system as described in claim 1 wherein the attachment members are sufficiently long to space the rail member above the mattress a distance sufficiently greater than the thickness of the mattress, to enable the rail member to impede a patient resting on the mattress from falling from the stretcher.

13. The system as described in claim 12 wherein the each of the attachment members comprise a plurality of attachment members extending vertically above the stretcher and the mattress when the system is attached to the stretcher, and positioned along the rail member, to impede a patient resting on the mattress from falling from the stretcher.

14. The system as described in claim 1 wherein the accessory support comprises a plurality of accessory supports spaced longitudinally on the rail member and extending vertically above the rail member to impede a patient resting on the mattress from falling from the stretcher.

* * * * *